US005192558A

United States Patent [19]

Sparrow et al.

[11] Patent Number: 5,192,558

[45] Date of Patent: Mar. 9, 1993

[54] OUTSIDE-CORNER PLASTERING TOOL

[75] Inventors: Jesse R. Sparrow, Phoenix; John A. Estep, Laveen, both of Ariz.

[73] Assignees: Don Hasselmann; Kenneth Oakes, both of Phoenix, Ariz.

[21] Appl. No.: 833,293

[22] Filed: Feb. 10, 1992

[51] Int. Cl.[5] ..... B05C 17/10

[52] U.S. Cl. ..... 425/87; 425/458; 15/235.7; 15/235.8

[58] Field of Search ..... 15/235.7, 235.8, 235.3, 15/235.4, 235.5, 235.6; 425/87, 458

[56] References Cited

U.S. PATENT DOCUMENTS

| | | | |
|---|---|---|---|
| 2,178,899 | 11/1939 | Shaffer | 15/235.7 |
| 2,701,465 | 2/1955 | Johnson et al. | 15/235.7 |
| 3,241,174 | 3/1966 | Callahan | 15/235.7 |
| 4,669,970 | 6/1987 | Perry | 425/458 |
| 5,010,618 | 4/1991 | Croft | 425/87 |
| 5,067,889 | 11/1991 | Humiston | 425/458 |

*Primary Examiner*—Jay H. Woo
*Assistant Examiner*—Khanh P. Nguyen

[57] ABSTRACT

A plaster's tool having a flexible blade which has a handle coupled to a member for dynamically folding the blade so that the tool may be manipulated and the blade dynamically folded by a person holding the handle to assume the correct angular configuration for laying a plaster bead along the outside corner formed by the juncture of two surfaces meeting at an angle of 180 degrees or greater. Another important feature of the tool embodiments is the fact that the blade readily assumes a flat, planar configuration providing easier loading of plaster onto the tool and the transfer of the plaster on the flat blade to the work surface.

3 Claims, 1 Drawing Sheet

OUTSIDE-CORNER PLASTERING TOOL

FIELD OF THE INVENTION

The invention relates to the cementatious arts. In particular, the invention relates to a finishing tool for applying cemenatious materials at angular wall junctions of 180 degrees of greater. Specifically, the invention relates to a tool for applying a radiused bead of cementatious material on such generally outward projecting junctions. It shall be understood that the invention is employed, generally, with cementatious materials and that references made herein to "plastering" and "plaster," or the like, shall be deemed as generic descriptors relating to such cementatious materials.

2. Prior Art

When a tool does not exist to perform a required task, a craftsman will improvise. To apply a bead of plaster to the outward projecting corner formed by the junction of two surfaces meeting at an angle greater than 180°, a special tool is required. The tool must be capable of bearing plaster to the junction to there thrust the plaster onto the junction and then form the plaster into a rounded bead which cosmetically finishes the corner. To this end, craftsman have bent and shaped pieces of scrap metal in a make-do effort to meet the demands of the job. The final results are passing fair but considerable time and effort will have been expended in attempting to produce a uniform bead with a smooth blend of bead boundaries into the adjacent structural surfaces.

When working with dry wall construction, the ability to blend the bead boundaries invisibly into the adjacent dry wall surfaces provides significant working efficiency since the craftsman does not have to return to the area to perform a smoothing operation on the flat surfaces of the adjacent wall board.

Hand-made beading tools are frequently discarded after use. More often than not they look exactly what they are: hand made devices, fabricated when the need arose, barely suitable for the task at hand, and not useful without modification for the next job encountered.

Upon reduction of the instant invention to practice, a search of the prior art was undertaken. The search disclosed U.S. Pat. No. 4,669,970, issued to John F. Perry on Jun. 2, 1987 for HAND TOOL FOR FINISHING CORNERS AND THE LIKE WITH A CEMENTIOUS MATERIAL. Perry discloses a tool with a backing plate to which a pliable sheet is affixed. The working edges of both the sheet and the plate have indented central portions. The working edge of the sheet extends outward beyond the working edge of the plate.

The Perry backing plate is manually bendable by the craftsman on the job site to adapt the tool to the shape of the junction on which a bead is to be applied. Perry discloses and claims the backing plate to be either tool steel or cold rolled mild steel; the plate selected having a thickness in the range of 18 to 20 gauge.

The necessity to manually bend and shape the tool, on the job site, as taught by Perry, is deemed to be a disadvantage. Since it is more convenient to store and transport the tool in its flattened condition, the backing plate will be subjected to repeated flexures, bending and straightening the tool, as the craftsman travels from one job site to another. Failure of the backing plate, due to metal fatigue, can be anticipated.

A more serious drawback of a tool which requires manual bending and shaping is that the tool is incapable of reacting dynamically with the significantly varying contours often encountered on the adjacent surfaces which form the corners to be beaded. Because the Perry tool is incapable of dynamic response, the craftsman must rework certain regions of the bead after first rebending and reshaping the tool. On certain corner junctions, such manual bending and shaping of the tool will have to be repeated several times.

It is an object of the present invention that a beading tool be provided which dynamically conforms to structural variation in corners formed by the junction of adjacent surfaces, which junction forms an exterior angle of 180° or greater.

SUMMARY OF THE INVENTION

The invention is a tool for applying a bead of cementatious material where two surfaces meet at a junction having an exterior angle of 180° or greater, the bead being applied to the exterior junction thus formed. The tool is made up of a flexible blade conformable to the junction of the two surfaces for carrying cementatious material to that junction to leave a bead of cementatious material there. There are also means coupled to the blade for dynamically folding the blade to further conform the blade to the two surfaces which form the junction to which a bead of cementatious material is to be applied.

Also disclosed is a handle coupled to the means for dynamically folding the blade so that the tool may be manipulated and the blade dynamically folded by a person holding the handle.

In a first embodiment of the tool, the blade has first and second sides. The means for dynamically folding the blade comprises first and second folding plates coupled to the blade adjacent the first and the second sides respectively. There are first and second pivot means pivotally coupling, respectively, the first and the second folding plates to the handle. And, there are first and second moment arms coupled respectively to the first and the second folding plates for creating first and second oppositely directed moments of force to pivotally rotate the first and the second folding plates and fold the blade.

DETAILS OF THE INVENTION

Figure 1:
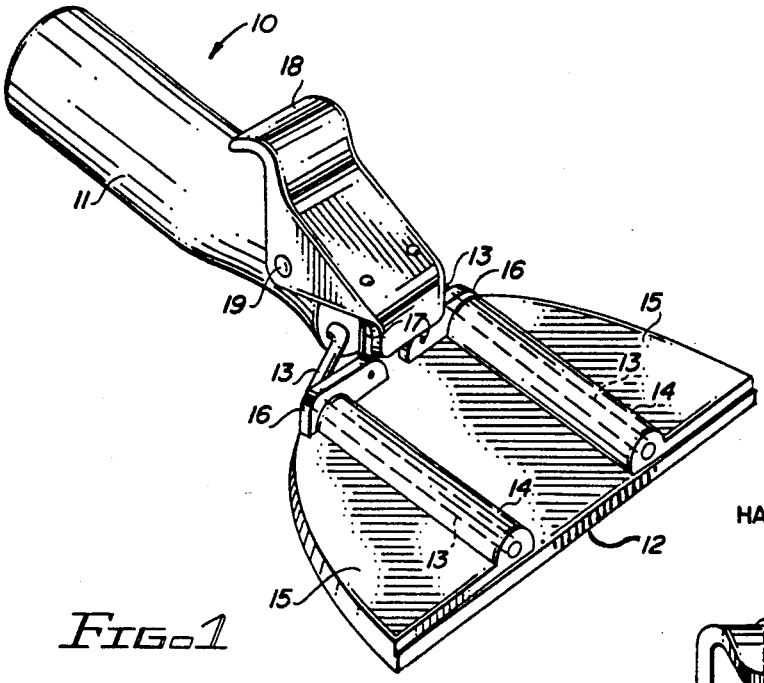
FIG. 1 is a perspective view of a first presently preferred embodiment of the outside-corner plastering tool.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further application of the principles of the invention as disclosed herein, as would normally occur to one skilled in the art to which the invention pertains.

The presently preferred embodiments of the invention are disclosed. The embodiment, 10 of FIGS. 1-3B, has a handle 11 for manipulating the tool and a flexible blade 12 for carrying plaster to a corner junction, deformably conforming to the junction, and shaping a plaster bead at the corner to there yield a cosmetically attractive finish.

A pair of reinforcing plates 15 are coupled, one on either side of center, to blade 12. Each of plates 15 has a rounded section 14, with a through bore, that pivotally couples plates 15 to handle 11 via pivotal coupling rod 13.

Reinforcing plates 15 are also comprised of moment arms 16 which are pivotally coupled through lever rods 17 to actuating lever 18. Actuating lever 18 is itself, in turn, pivotally coupled to handle 11 by pivot pins 19.

Figure 2:
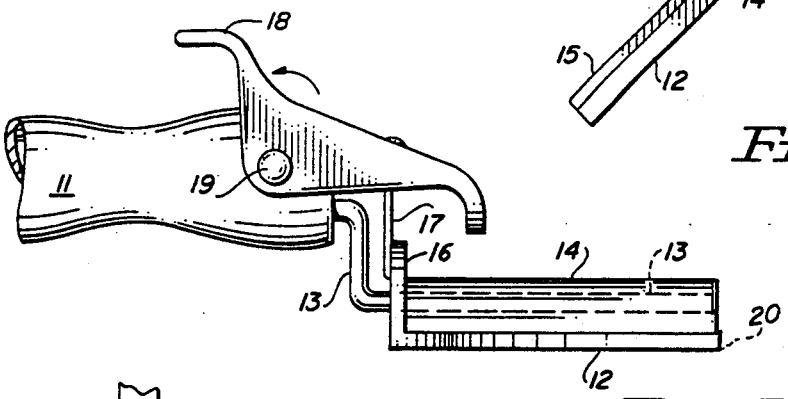
FIG. 2 is a side elevation of the tool of FIG. 1.

The working end 20 of blade 12, preferably, does not extend significantly beyond the limits of reinforcing plates 15 in the manner illustrated in phantom outline in FIG. 2. In practice, such extension is not necessary to form a cosmetically attractive bead on the corner's junction and tends to decrease the useful working life of the tool.

Figure 3B:
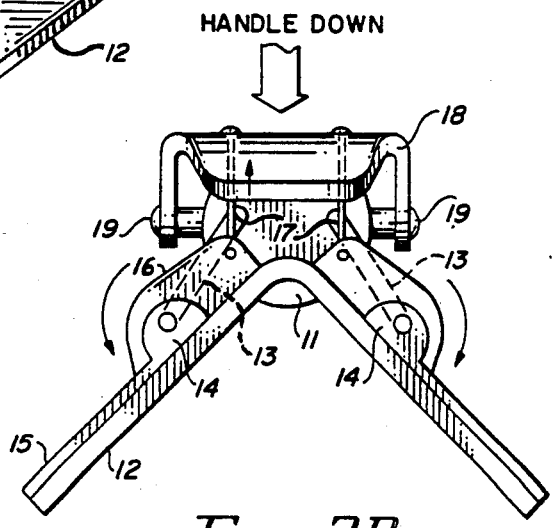
FIGS. 3A and 3B are side and end elevations, respectively, of the tool of FIG. 1 illustrating the dynamic flexure of the tool to conform-in-use to corner contours.
Figure 3A:
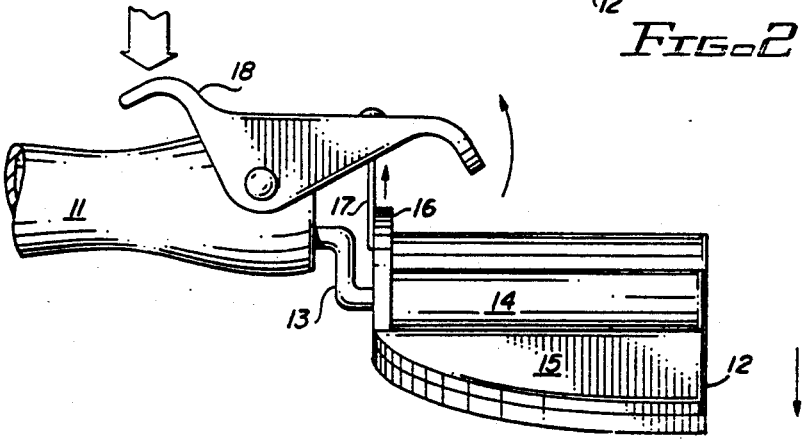

As indicated in FIGS. 3A and 3B, depressing lever handle 18 downward, causes reinforcing plates to rotate oppositely so as to draw the side edges of blade 12 downward as lever rods 17 are drawn upwardly to actuate moment arts 16 about pivot rods 13. These actions cause blade 12 to assume the configuration of an outside corner junction. See FIG. 3B.

Flexible working edge 20 conforms to the corner to create a plaster bead at the junction. The folding of the blade causes it to wrap around the corner junction and to contact the adjacent surfaces with a wiping action so as to blend the resulting bead's boundaries invisibly into the adjacent surfaces. Refer to FIG. 3B.

In the case of the tool embodiment, folding of the blade to maintain a constant, dynamic, wiping action on the surfaces adjacent to the junction at which the plaster bead is being laid, is under control of the craftsman at all times as the work progresses. There is never any need for the craftsman to stop his work to manually bend and shape the tool to a suitable configuration as necessary to proceed.

Another important feature of the tool embodiments is the fact that the blade of the tool readily assumes a flat, planar configuration. Thus, the tool may be utilized to work a flat surface as well as a corner junction. Further, it is easier to load plaster onto a tool having a flat blade and then transfer the plaster on the flat blade to the work surface. So too, it is far easier to remove residual plaster from a flat blade by simply wiping the blade on the edge of the plaster container. No known prior art devices have all the advantages found with the tool disclosed herein.

What has been described is a plaster's tool having a flexible blade which dynamically fold to assume the correct angular configuration for laying a plaster bead along the outside corner formed by the juncture of two surfaces meeting at an angle of 180 degrees or greater.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, THAT

WHICH IS CLAIMED IS:

1. A tool for applying a bead of cementatious material where two surfaces meet at a junction having an exterior angle of 180° or greater, said tool comprising:

a flexible blade conformable to the junction of two surfaces for carrying cementatious material to the junction to leave a bead of cementatious material on the junction;

means coupled to said blade for dynamically folding said blade to further conform said blade to the two surfaces which form the junction to which a bead of cementatious material is to be applied;

a handle coupled to said means for dynamically folding said blade whereby said tool may be manipulated and said blade dynamically folded by a person holding said handle;

wherein said blade has first and second sides and said means for dynamically folding said blade further comprises:

first and second folding plates coupled to said blade adjacent said first and said second sides respectively;

first and second pivot means pivotally coupling respectively said first and said second folding plates to said handle; and first and second moment arms coupled respectively to said first and second folding plates for creating first and second oppositely directed moments of force to pivotally rotate said first and said second folding plates and fold said blade.

2. The tool of claim 1 wherein said blade has two sides and is coupled to said handle at a point generally central of said two sides and said means for dynamically folding said blade comprises means for contacting said blade adjacent said two sides and forcing said sides away from said handle whereby said blade is folded along a line through said central coupling point.

3. The tool of claim 2 wherein said blades readily assumes a flat, planar configuration;

wherein said blade flat configuration allows for ease in loading of cementatious material onto said blade;

further, said tool may be utilized to work a flat surface as well as corner junction.

* * * * *